United States Patent [19]

Higuchi et al.

[11] 4,009,644

[45] Mar. 1, 1977

[54] ROTARY ACTUATOR

[75] Inventors: Yasuo Higuchi; Yosio Mitumura, both of Komaki, Japan

[73] Assignee: Chukyo Electric Co., Ltd., Japan

[22] Filed: Apr. 2, 1975

[21] Appl. No.: 564,445

Related U.S. Application Data

[63] Continuation-in-part of Ser. No. 378,497, July 12, 1973, abandoned.

[30] Foreign Application Priority Data

July 14, 1972 Japan ..... 47-69927

[52] U.S. Cl. ..... 92/125

[51] Int. Cl.[2] ..... F01C 9/00

[58] Field of Search ..... 92/125, 124, 123, 122, 92/121, 120, 249; 277/189

[56] References Cited

UNITED STATES PATENTS

| | | | |
|---|---|---|---|
| 3,030,934 | 4/1962 | Herbst | 92/125 |
| 3,215,046 | 11/1965 | Drake | 92/125 |
| 3,286,602 | 11/1966 | Butner et al. | 92/122 |
| 3,659,503 | 5/1972 | Ehluss | 92/125 |
| 3,688,645 | 9/1972 | Reaves | 92/125 |
| 3,750,535 | 8/1973 | Higuchi | 92/125 |

FOREIGN PATENTS OR APPLICATIONS

| | | | |
|---|---|---|---|
| 1,155,982 | 10/1963 | Germany | 92/125 |

*Primary Examiner*—Paul E. Maslousky
*Attorney, Agent, or Firm*—Kurt Kelman

[57] ABSTRACT

In a rotary actuator having a relatively small angle of rotation comprising a cylinder having a sectoral section and a vane slidably moving within the cylinder, a sectoral cylindrical seal member of synthetic resin is fitted in contact with the inner surface of the cylinder, and compressed axially by means of end covers. Thus, the seal member in cooperation with a packing provided on the outer surface of the vane prevents leakage of fluid through the corners of the surface on which the vane slides. Manufacturing of the vane in this case may be facilitated by bonding a gasket to the bottom of the peripheral groove of the vane so as to place the packing on the gasket.

2 Claims, 15 Drawing Figures

ROTARY ACTUATOR

BACKGROUND OF THE INVENTION

This application is a continuation-in-part application of a copending application, U.S. Ser. No. 378497, filed July 12, 1973, now abandoned.

The present invention relates generally to a rotary actuator and, more particularly to a rotary actuator having a small angle of rotation and a seal member improving the sealability of the corners between the inner surface of the cylinder having a sectoral section and the inner surfaces of the end covers.

A rotary actuator having a small angle of rotation wherein a cylinder having a circular section is used has a disadvantage that the cylinder takes more volume than necessary thereby requiring larger volume for the actuator. Accordingly, it is preferable to use in such an actuator having a small angle of rotation a sectoral cylinder having a sectoral section corresponding to the angle of rotation of the vane.

On the other hand, however, since in the rotary actuator including a cylinder having a sectoral section, as in the rotary actuator including a cylinder having a circular section, there are formed in the surface on which the vane slides corners at which the inner surface of the cylinder and the inner surfaces of the covers meet with each other, it is difficult to prevent leakage of liquid at such corners completely. Therefore, such rotary actuator has been inferior in workability and sealability to a rectilinear motion actuator in which a disc piston moves axially within a circular cylinder having a continuous cylindrical sliding surface.

SUMMARY OF THE INVENTION

Accordingly, an object of the present invention is to provide a rotary actuator including a cylinder of a sectoral section having a high sealing characteristic comparable to that of the rectilinear motion actuator.

Another object of the present invention is to provide a rotary actuator which is simple in structure, easy to manufacture, and yet including a sealing device having an excellent sealing characteristic at the corners whereat the inner surface of the cylinder and the inner surfaces of the end covers meet with each other.

In order to accomplish these and other objects, in the rotary actuator accoding to the present invention, there is inserted a seal member of, for example, synthetic resin, in a sectoral cylindrical form slightly greater in length than the axial length of the cylinder in contact with the inner surface of the cylinder, and the seal member is compressed uniformly and axially by end covers closing the ends of the cylinder.

Also, in order to facilitate manufacturing of the actuator without less of reliability, it is proposed to bond a gasket around the periphery of the vane on which the sealing gasket is disposed. By applying this process, the production cost for the vane is greatly reduced.

BRIEF DESCRIPTION OF THE DRAWINGS

The invention will be better understood from the following description taken in connection with the accompanying drawings, in which.

Figure 1:
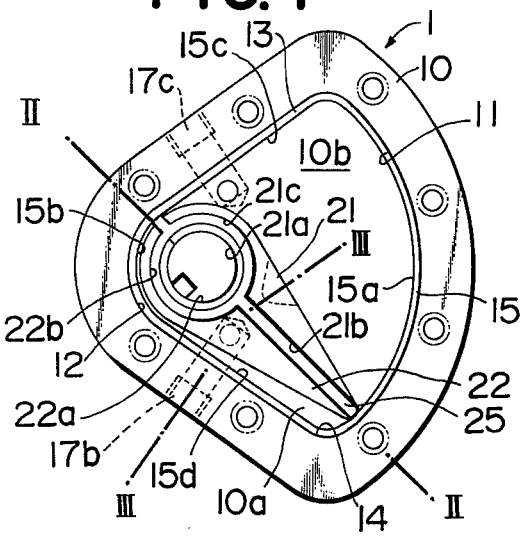
FIG. 1 is an end view of the rotary actuator according to one embodiment of the present invention with the end covers taken away.
Figure 2:
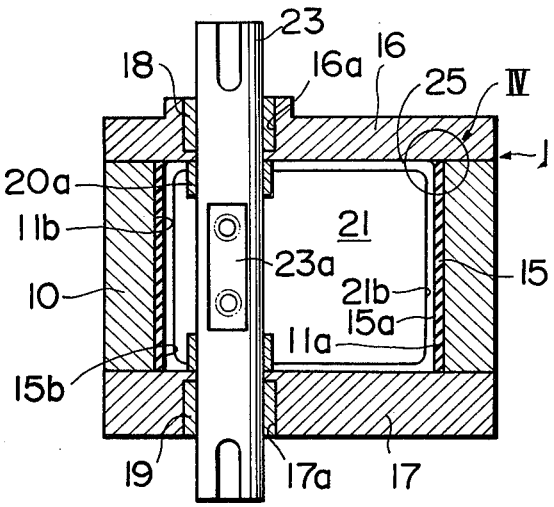
FIG. 2 is a sectional view taken along the line II—II of FIG. 1.

DETAILED DESCRIPTION OF EMBODIMENT:

Referring now to the drawings, an embodiment of the present invention will be described.

The rotary actuator 1 according to the present invention comprises a cylinder 10 having a substantially sectoral section, as shown in FIG. 1. The cylinder 10 comprises two circumferential inner surfaces 11 and 12 having a common center of curvature and opposite to each other with said center of curvature therebetween, and flat surfaces 13 and 14 continuing to the surfaces 11 and 12. Within the cylinder 10 there is inserted a sectoral cylindrical seal member 15 having a sectoral section and a predetermined thickness, with its outer surfaces in tight contact with the inner surfaces of the cylinder 10. The seal member 15 is designed to have the axial length slightly larger than that of the cylinder 10 and formed so that the angle between the end faces of the seal member and the inner surfaces thereof is right angle and that the corner portion is sufficiently sharp not to allow no roundness formed thereat. The seal member 15 also has an inner surface **15*a* along the circumferential inner surface 11 of the cylinder 10, an inner surface 15*b* along the circumferential inner surface 12, and inner surfaces 15*c* and 15*d* along the flat surfaces 13 and 14**.

Figure 5:
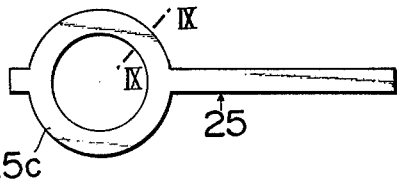
FIG. 5 is a side view of a packing provided on the outer surface of the vane.
Figure 6:
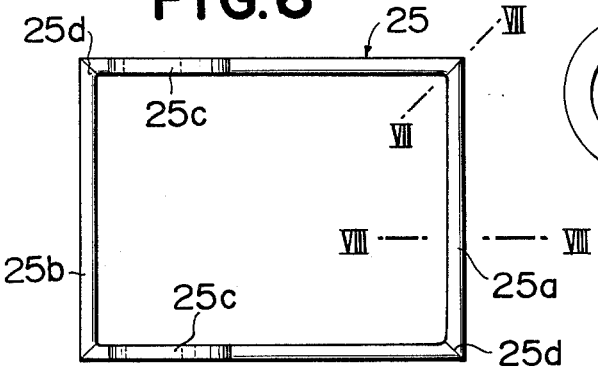
FIG. 6 is a plan view of the packing of FIG. 5.
Figure 10:
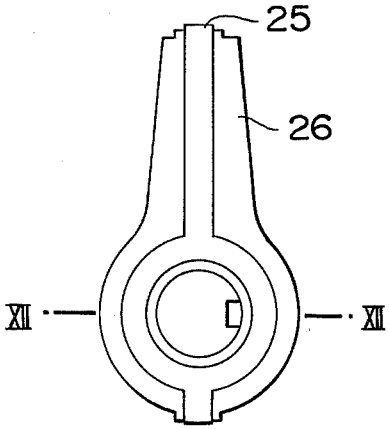
FIG. 10 is an end view of an alternate embodiment of the vane which may be incorporated in the rotary actuator of the present invention.
Figure 11:
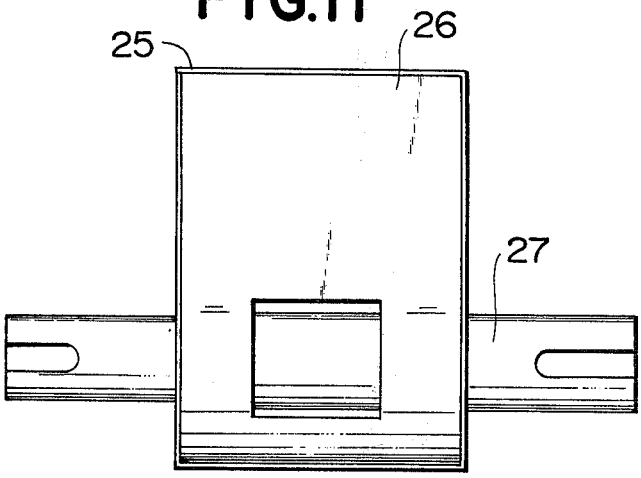
FIG. 11 is a side view of the vane illustrated in FIG. 10.

Within the cylinder there is inserted a vane 20 comprising two portions 21 and 22. These two portions 21 and 22 are provided respectively with grooves **21*a* and 22*a* which, in cooperation with each other, define a circular hole for receiving a shaft 23 therewithin. The portions 21 and 22 are coupled to each other by suitable means such as screws (not shown) with a packing to be disposed between themselves and are fixed on the shaft 23 by means of, for example, a key 23*a* or screws (not shown). On the periphery of the portion 21 of the vane there are provided a rectilinear packing groove 21*b* adjacent the joint with the portion 22 and a semicircular packing groove 21*c* adjacent the groove 21*a*. On the periphery of the groove 22*a* of the porion 22 there is provided a groove 22*b* continuing to the packing grooves 21*b* and 21*c* of the portion 21. In these packing grooves there is mounted a packing 25 shown in FIGS. 5 and 6.**

The packing 25 comprises a pair of ring-shaped portions 25*c* adapted to be mounted in the packing grooves 21*c* and 22*b*, and portions 25*a* and 25*b* performing sealing function in contact respectively with the inner suraces 15*a* and 15*b* of the seal member 15, and these packing portions are formed in one body. Between the ring-shaped portions 25*c* and the shaft 23 there is mounted a bushing 20*a*.

After the vane 20 is mounted within the cylinder 10, end covers 16 and 17 are mounted at the ends of the cylinder by suitable means such as bolts (not shown). The covers 16 and 17 are provided respectively with holes 16*a* and 17*a* in which bearings 18 and 19 are respectively fitted for rotatably supporting the shaft 23. When the covers 16 and 17 are mounted to the cylinder, since the seal member 15 is designed slightly longer than the axial length of the cylinder, the seal member is compressed axially to apply the pressure required for sealing to the contact surface between the end faces of the seal member 15 and the both end covers 16 and 17. At this time, the axial strain is produced within the seal member 15 substantially uniformly throughout the entire axial length thereof without producing any deformation in the end faces of the seal member.

Figure 3:
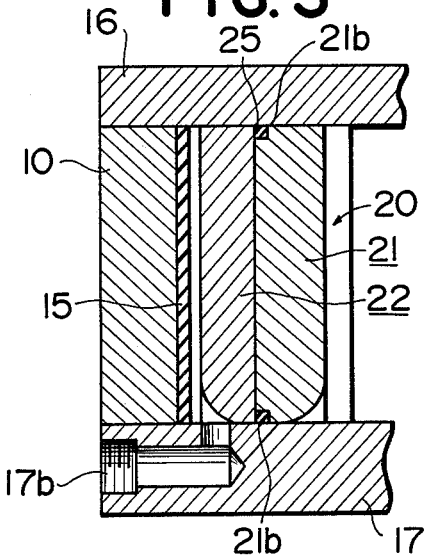
FIG. 3 is a sectional view taken along the line III — III of FIG. 1.
Figure 4:
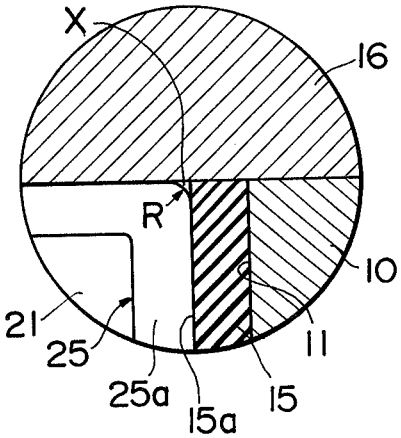
FIG. 4 is an enlarged partial view of a portion designated IV in FIG. 2.

The cover 17 is provided with ports 17*b* and 17*c* (FIGS. 1 and 3) opening in the cylinder chamber with the vane therebetween, and through the ports the fluid is supplied and exhausted to drive the vane. In other words, when the fluid is supplied through the port 17*b* into the cylinder chamber 10*a* and the fluid within the cylinder chamber 10*b* is exhausted through the port 17*c*, the vane is driven anti-clockwise in FIG. 1, and when the fluid is supplied through the port 17*b* into the cylinder chamber 10*b* and the fluid within the cylinder chamber 10*a* is exhausted through the port 10*a*, the vane is driven clockwise. Thus the vane swings about the shaft 23. At this time, the sealing characteristic between the suction and discharge sides within the cylinder is dependent upon the sealing characteristic between the corner defined by the circumferential inner surfaces 15*a* and 15*b* of the seal member and the inner surfaces of the end covers 16 and 17 and the corner 25*d* of the packing 25 corresponding thereto.

On the other hand, since the seal member 15 is formed so sharp that no roundness is formed at the corner defined by the both end faces and the inner surfaces and yet compressed axially by the end covers upon assembly, leakage of the fluid through the contact surface between the seal member and the end covers can be substantially completely prevented not only radially but also circumferentially. Accordingly, the leakage of the fluid in the neighborhood of the corner of the packing 25 is dependent upon the gap produced by the shape X of the corner 25*d*.

When the corner 25*d* of the packing 25 is formed sufficiently sharp so that the curved surface (radius R) thereof has the radius of curvature in the order of 0.01 mm, said gap X is in the order of 0.004 mm which is comparable to the gap between the O-ring of the cylindrical piston and the cylindrical surface of the cylinder Accordingly, when operated by hydraulic pressure or pneumatic pressure using lubrication, the leakage can be regarded as substantially zero. Further, since the seal member 15 has a certain degree of compressibility, it can compensate for the difficulties in accuracy of machining of other components.

Figure 7:
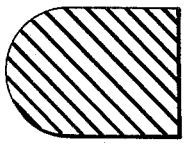
FIG. 7 is an enlarged sectional view taken along the line VII—VII of FIG. 6.
Figure 8:
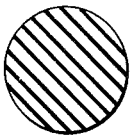
FIG. 8 is an enlarged sectional view taken along the line VII—VII of FIG. 6.
Figure 9:
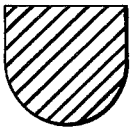
FIG. 9 is an enlarged sectional view taken along the line IX—IX of FIG. 5.

The packing 25 has, in the rectilinear portions such as 25*a* and 25*b*, a circular section as shown in FIG. 8 and, in the corner 25*d* and ring-shaped portion 25*c*, an angular-shape having corners at the outside as shown in FIGS. 7 and 9, respectively to improve the sealing characteristic.

As already explained, the vane 20 comprises two portions 21 and 22. The reason for such construction lies primarily in the fact that, if the vane body is made as a single unit by, for example, casting process, the bottom surface of the grooves corresponding to those grooves 21*b*, 21*c* and 22*b* will be rough and, further, the parting lines of the cast will necessarily appear in the respective center lines of the grooves. If machining of these surfaces is attempted, it will be difficult to eliminate mismatches resulting from the different machining steps or it will be very expensive to achieve satisfactory results. Thus, the vane 20 was divided into two portions for facilitating the machining of grooves 21*b*, 21*c* and 22*b*.

It may be proposed to utilize so-called investment casting (lost wax) process to obtain a unitary part with smooth surfaces; however, it also increase the manufacturing cost.

Hence it is proposed to eliminate the need for accurate machining of the vane grooves by a simple solution applicable both for a single body construction of the vane and a two-portion construction of the vane.

Figure 14:
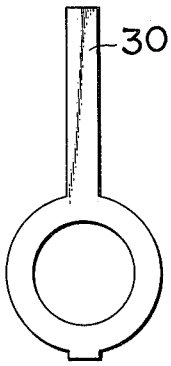
FIG. 14 is an end view of a gasket incorporated in the vane of FIG. 10.
Figure 15:
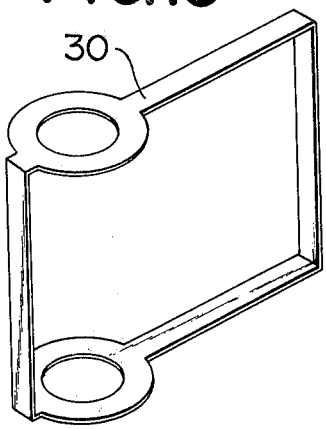
FIG. 15 is a perspective view of the gasket shown in FIG. 15.
Figure 13:
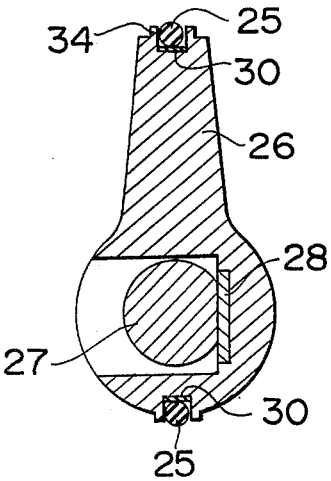
FIG. 13 is a cross section taken along the line XIII—XIII of FIG. 12.
Figure 12:
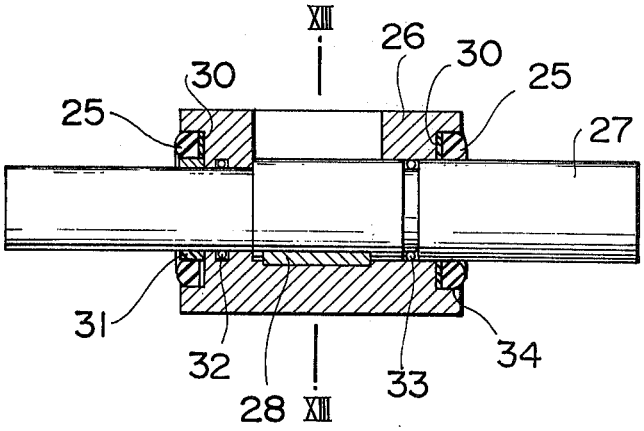
FIG. 12 is a cross-sectional view taken along the line XII—XII of FIG. 10.

Referring to FIGS. 10 through 13, there is illustrated an alternate vane 26 the body of which is formed in one piece. The vane 26 is mounted on a shaft 27 and secured thereto by a flat key 28, 32 and 33 are O-rings for sealing purpose and 31 is a spacer. As shown in FIGS. 12 and 13, a groove 34 is formed in the periphery of the vane which is adapted to receive the packing 25 shown in FIGS. 5 and 6 so as to partly expose thereof. However, in this alternate embodiment, it should be noted that a gasket 30 illustrated in FIGS. 14 and 15 is disposed between the packing 25 and the bottom surface of the groove 34. This gasket is preferably made of elastic material and is given a suitable thickness to be received in the groove 34. Also, it is preferable to bond this gasket 30 to the bottom surface of the groove by a suitable adhesive or cement.

By disposing the gasket in the manner explained, the surface of the gasket opposite that facing the bottom surface will become a suitable surface for cooperating with the packing 25.

As evident from the above description, while having the sliding surface with corners, the rotary actuator according to the present invention has the sealing characteristic comparable to those of a rectilinear motion actuator having a sliding surface with circular section, and can reduce the manufacturing cost.

What is claimed is:

1. In a rotary actuator having a sectoral sectioned cylinder with two ends and larger and smaller circumferential inner surfaces opposing each other and having the same center of curvature in common and different radii of curvature, a pair of end covers for closing tightly the ends of said cylinder, a shaft concentric with said curvature and supported rotatably by the end covers, and a vane secured to said shaft and pivotally movable within said cylinder, the improvement which comprises the combination of a sectoral cylindrical seal member of a predetermined thickness disposed within said cylinder in contact with the inner surfaces thereof, said seal member having a sectoral section similar to that of said cylinder, said seal member having a normal length greater than that of the cylinder and having squared edge portions, said seal member being compressed uniformly along the normal length in the axial direction by said end covers, the outer peripheral surface of said seal member not being fixed to the inner surfaces of said cylinder, a relatively thin gasket of elastic material and flat surfaces disposed within a groove around the entire periphery of said vane, said gasket having ring-shaped portions and rectilinear portions, an inner surface thereof being bonded to the bottom surface of said groove to provide a smooth, continuous surface for the bottom of said groove, and a packing thicker than said gasket disposed within said groove over said gasket and having ring-shaped portions and rectilinear portions, said packing sealably contacting another surface of said gasket, the inner surfaces of said end covers and the inner surface of said seal member.

2. A rotary actuator as claimed in claim 1 wherein said vane has a body constructed to be a unitary element.

* * * * *